US005883066A

United States Patent [19]

Herbots et al.

[11] Patent Number: 5,883,066

[45] Date of Patent: Mar. 16, 1999

[54] LIQUID DETERGENT COMPOSITIONS CONTAINING CELLULASE AND AMINE

[75] Inventors: Ivan Maurice Alfons Jan Herbots, Wetteren; Madeleine Petronella Jansen, Leuven, both of Belgium

[73] Assignee: The Procter & Gamble Company, Cincinnati, Ohio

[21] Appl. No.: 833,642

[22] Filed: Apr. 8, 1997

Related U.S. Application Data

[63] Continuation of Ser. No. 564,107, filed as PCT/US94/0a6154, Jun. 2, 1994.

[30] Foreign Application Priority Data

Jun. 28, 1993 [EP] European Pat. Off. ..... 93870122

[51] Int. Cl.[6] ..... C11D 3/386

[52] U.S. Cl. ..... 510/392; 510/320; 510/329; 510/351; 510/426; 510/498; 435/188

[58] Field of Search ..... 510/392, 530, 510/320, 329, 351, 426, 498; 435/188

[56] References Cited

U.S. PATENT DOCUMENTS

| | | | |
|---|---|---|---|
| 4,479,881 | 10/1984 | Tai | 252/8.8 |
| 4,562,002 | 12/1985 | Neiditch et al. | 252/8.75 |
| 4,661,289 | 4/1987 | Parslow et al. | 252/547 |
| 5,174,927 | 12/1992 | Honsa | 252/543 |
| 5,238,843 | 8/1993 | Carpenter et al. | 435/264 |

FOREIGN PATENT DOCUMENTS

| | | | |
|---|---|---|---|
| 0 011 340 A1 | 5/1980 | European Pat. Off. | C11D 3/30 |
| 0 026 528 A1 | 4/1981 | European Pat. Off. | C11D 1/62 |
| 0 026 529 A1 | 4/1981 | European Pat. Off. | C11D 1/62 |
| 0026520 | 4/1981 | European Pat. Off. . | |
| 0 120 528 A1 | 10/1984 | European Pat. Off. | C11D 3/30 |
| 0 137 615 A1 | 4/1985 | European Pat. Off. | C11D 3/30 |
| 0 137 616 A1 | 4/1985 | European Pat. Off. | C11D 7/50 |
| 0 160 762 A1 | 11/1985 | European Pat. Off. | C11D 7/50 |
| 0173 397 A2 | 3/1986 | European Pat. Off. | C11D 3/386 |
| 0 177 165 A2 | 4/1986 | European Pat. Off. | C11D 3/386 |
| 0177165 | 4/1986 | European Pat. Off. . | |
| 0 495 258 A1 | 7/1992 | European Pat. Off. | C11D 3/386 |
| 0 495 554 A1 | 7/1992 | European Pat. Off. | C11D 3/386 |
| 0495258 | 7/1992 | European Pat. Off. . | |
| 0 540 782 A1 | 5/1993 | European Pat. Off. | C11D 3/386 |
| 0 531 372 B1 | 2/1995 | European Pat. Off. | C11D 3/386 |
| 2 094 826 | 9/1982 | United Kingdom | C11D 3/386 |
| 2 095 275 | 9/1982 | United Kingdom | C11D 3/386 |
| WO 89/09259 | 10/1989 | WIPO | C11D 3/386 |

*Primary Examiner*—Kery Fries
*Attorney, Agent, or Firm*—Pankaj M. Khosla; Ken K. Patel; J. C. Rasser

[57] ABSTRACT

The present invention is a liquid detergent composition containing anionic surfactant and cellulase. Said composition further comprises hydrophobic amines as cellulase stabilizers.

2 Claims, No Drawings

LIQUID DETERGENT COMPOSITIONS CONTAINING CELLULASE AND AMINE

This is a continuation of application Ser. No. 08/564,107, filed as PCT/US94/06154, Jun. 2, 1994.

TECHNICAL FIELD

The present invention relates to liquid detergent compositions containing anionic surfactant and cellulose. In the compositions according to the present invention the cellulase is stabilized.

BACKGROUND OF THE INVENTION

Liquid detergent compositions comprising enzymes are well known in the art. It is desirable that such compositions should exhibit long term stability with respect to the enzyme. However, it has been observed that in anionic surfactant liquid detergent compositions the stability of enzymes, in particular cellulases is greatly reduced. The incorporation of cellulase enzymes in such compositions is highly desirable. Thus, the storage instability of such compositions represents a problem to the detergent manufacturer.

It is believed that the reason for the cellulase instability in the presence of anionic surfactants lies with the interactions which occur between the anionic surfactant and the three dimensional structure of the cellulase enzyme. This results in the unfolding of the enzyme and a reduction in its activity.

It has also been observed that this problem is more acute in the presence of protease enzyme. It is thought that the unfolded cellulase enzyme is more vulnerable to attack by protease. Thus, the presence of proteases further deactivates the cellulases.

Therefore it is an object of the invention to provide a liquid detergent composition which comprises anionic surfactant and cellulase, which is storage stable.

In response to this object, the present invention proposes to formulate liquid detergent compositions which comprise liquid detergent soluble hydrophobic amines, which may be primary, secondary, or tertiary amines, or quaternary ammonium compounds, as cellulase stabilizing compounds.

An advantage of the present invention is that it is applicable to the protection of any cellulase, and also finds application in the presence of protease.

Amines have been disclosed in the art in liquid detergent compositions.

EP 160 762, EP 137 615 and EP 137 616 disclose liquid detergents which comprise cyclohexylamine. Compositions are exemplified which comprise anionics, protease and amylase, but there is no mention of cellulase. The role of the cyclohexylamine therein is to stabilize the compositions which are in the form of microemulsions.

EP 177 165, discloses detergent compositions which comprise anionics, cellulase and a variety of primary, secondary, and tertiary amines and quaternary ammonium compounds. The primary, secondary and tertiary amines in EP 177 165 all have at least one long alkyl chain. The compositions in the EP 177 165 mandatorily comprise clay. EP 177 165 does not disclose that amines can stabilize cellulases.

EP 11 340 discloses soften through the wash detergent compositions which comprise tertiary amines and clay. The compositions in EP 11 340 comprise no cellulase.

DE 32 07 487, GB 2 094 826, GB 2 095 275 and EP 137 397 disclose compositions which comprise anionics, cellulase, protease and quaternary ammonium compounds. None of these documents disclose that amines can stabilize cellulases.

EP 120 528 discloses compositions comprising anionics, cellulase with other enzymes, as well as tertiary amines. The tertiary amines in EP 120 528 have at least one long alkyl chain. EP 120 528 does not disclose that amines can stabilize cellulases.

EP 26 528 and EP 26 529 disclose compositions comprising anionics and quaternary ammonium compounds. Both EP 26 528 and EP 26 529 do not disclose cellulase.

WO 91/17243 and EP application numbers 91202880.0, 92200101.2 and 91202882.6 disclose Carezyme®, including in liquid detergents. They do not mention amines.

SUMMARY OF THE INVENTION

The compositions according to the present invention are liquid detergent compositions comprising anionic surfactant and cellulase enzyme, characterized in that they further comprise a stabilizing amount of amine. The compositions according to the present invention preferably contain protease. The amines in the present invention are amines and quaternary ammonium compounds according to the formulae:

$R_1R_2R_3N$ wherein $R_1$ and $R_2$ are independently H or a $C_1$–$C_9$ alkyl chain, and $R_3$ is a $C_1$–$C_9$ alkyl chain or cyclopentyl cyclohexyl or cycloheptyl, or $R_4R_5R_6R_7N^+ X^-$ wherein X is an halogen, $R_4$ is a $C_6$ $C_{22}$ alkyl chain, $R_5$,$R_6$ and $R_7$ are independently $C_1$–$C_9$ alkyl chain, hydroxyethyl or hydroxypropyl, or mixtures thereof.

DETAILED DESCRIPTION OF THE INVENTION

The liquid detergent compositions according to the present invention comprise three essential components, an anionic surfactant, cellulase enzyme and stabilizing amount of a hydrophobic amine.

The Amine

Stabilizing amines of the detergent composition according to the present invention comprise from 0.5% to 10% by weight of the total composition, preferably from 1% to 8%, most preferably from 2% to 5% of a cellulase stabilizing amine. Hydrophobic amines as used herein refer to amines which can form a mixed micelle with an anionic surfactant and where the carbon chain length of the alkyl group is greater than $C_3$.

Suitable amines for use herein include amine according to the formula $R_1R_2R_3N$ wherein $R_1$ and $R_2$ are independently H or a $C_1$–$C_9$ alkyl, preferably H or a $C_1$–$C_3$ alkyl chain, $R_3$ is a $C_2$–$C_9$, preferably $C_4$–$C_8$ alkyl chain, or cyclopentyl, cyclohexyl or cycloheptyl. Preferred amines according to the formula herein above are n-alkyl amines and aryl amines. Particularly preferred are cyclohexylamine and n-hexylamines. Suitable amines for use herein may be selected from N-methyl N-hexyl amine, N,N-diethyl n-hexylamine, n-butyl amine, n-octyl amine, n-dodecyl amine, N-methyl cyclohexylamine, N,N,-diethyl cyclohexylamine and dicyclohexylamine.

Also suitable for use herein are quaternary ammonium compounds according to the formula $R_4R_5R_6R_7N+X-$ wherein X is a halogen, $R_4$ is a $C_6$–$C_{22}$ alkyl chain, preferably from $C_8$ to $C_{12}$, $R_5$, $R_6$ and $R_7$ are independently a $C_1$–$C_3$, or hydroxyethyl or hydroxypropyl, or mixtures thereof. Preferred quaternary ammonium compounds according to the formula herein above are dodecyltrimethyl ammonium chloride, tetra ethyl ammonium chloride and tetradecyl trimethyl ammonium chloride.

Without wanting to be bound by theory, it is believed that it is the hydrophobicity of the amine which is responsible for the protection of the cellulase enzymes. The hydrophobic amine acts as counter ion resulting in the rearrangement of the anionic surfactant to produce a 'shielding-off' effect by the neutral ion pair formation of hydrophobic amine-anionic surfactant in the surfactant phase of the liquid detergent.

Cellulase

As an essential component, the compositions herein comprise a cellulytic enzyme, or mixtures thereof. There are a large variety of cellulases available to the detergent formulator, all of which are suitable for use herein.

Suitable cellulases in the present invention may be any bacterial or fungal cellulase having an optimum pH from 5 to 11.5. Suitable cellulases which have an optimum activity at alkaline pH values are described in the British patent specifications GB 2 075 028 A (Novo Industri A/S, GB 2 094 826 A (Kao Soap Co. Ltd.). Examples of such alkaline cellulases are cellulases produced by the strain of Humicola insolens (Humecola grisea var. thermoidea), particularly the Humicola strain DSM 1800, and cellulases produced by a fungus belonging to the genus Aeromonas, and cellulase extracted from the hepatopancreas of a marine mullosc (Dolabella Auricula Solander).

Preferred cellulases for use herein, can be screened according to the following method.

The activity of enzymes and particularly the activity of cellulase enzyme has been defined for various applications by different analytical methods. These methods all attempt to provide a realistic assessment of the expected in use performance or at least a measurement correlating with the in use performance. As has been detailed in European Patent Application EP-A-350098, many of the methods, particularly these frequently used by cellulase manufacturers, are not sufficiently correlated with the in use performance of cellulase in laundry detergent compositions. This is due to the various other usage conditions for which these activity measurement methods have been developed.

The method described in EP-A-350098, has been developed to be and to have a predictive correlation for the ranking of cellulase activity in laundry detergent compositions.

The present invention therefore uses the method disclosed in EP-A-350098 to screen cellulases in order to distinguish cellulases which are useful in the present invention and those which would not provide the objectives of the present invention. The screening method, hereinafter referred to as C14CMC-Method, which has been adopted from the method disclosed in EP-A-350098, can be described as follows:

Principle:

The principle of the C14CMC-Method for screening is to measure at a defined cellulase concentration in a wash solution the removal of immobilized carboxy methyl cellulose (CMC) from a cloth substrate. The removal of CMC is measured by radio-active labelling of some of the CMC by using C14 radio-active carbon. Simple counting of the amount of radio-active C14 on the cloth substrate before and after the cellulase treatment allows the evaluation of the cellulase activity.

Sample preparation:

CMC preparation: The radio-active CMC stock solution is prepared according to Table I. The radio-active CMC can be obtained by methods referred to in EP-A-350098.

Fabric substrates: The fabric substrates are muslin cotton swatches having a size of 5 cm×5 cm. They are inoculated with 0.35 ml of the radio-active labelled CMC stock solution in their center. The muslin cotton swatches are then airdried.

Immobilization of CMC: To immobilize the radio-active labelled CMC on the muslin cotton swatches, laundry-meter equipment "Linitest Original Haunau" made by Original Haunau, Germany, is used. A metal jar of the launderometer is filled with 400 ml of hard water (4 mmol/liter of $Ca^{++}$ ions). A maximum number of 13 swatches can be used per jar. The jar is then incubated in a heat-up cycle from 20° C. to 60° C. over 40 minutes in the launderometer equipment. After incubation the swatches are rinsed under running city water for 1 minute. They are squeezed and allowed to airdry for at least 30 minutes.

According to EP-A-350098 samples of the swatches with immobilized radio-active CMC can also be measured as "blank samples" without washing.

Sample treatment:

Laundry test solution: The laundry test solution is prepared according to the composition of Table II. It is balanced to pH 7.5. The laundry test solution is the basis to which a cellulase test sample is added. Care should be taken to not dilute the laundry test solution by adding water to a 100% balance prior to having determined the amount of cellulase to be added. The amount of cellulase which is used in this screening test should be added to provide $25\times10^{-6}$ weight percent of cellulase protein in the laundry test solution (equivalent to 0.25 milligram/liter at 14.5° C.).

Wash procedure: The swatches thus inoculated with radio-active labelled CMC are then treated in a laundry simulation process. The laundry process is simulated in the launderometer type equipment, "Linitest, Original Haunau", by Original Haunau, Haunau Germany. An individual swatch is put into a 20 $cm^3$ glass vial. The vial is filled with 10 ml of the laundry test solution and then sealed liquid tight. Up to 5 vials are put into each launderometer jar. The jar is filled with water as a heat transfer medium for the laundering simulation. The laundering simulation is conducted as a heat-up cycle from 20° C. to 60° C. over 40 minutes.

After the processing of the samples the vials are submerged in cold water and subsequently each swatch is taken out of its vial, rinsed in a beaker under running soft water, squeezed and allowed to airdry for at least 30 minutes.

Measurement:

In order to measure radio-active labelled CMC removal, a scintillation counter, for example, a LKB 1210 Ultrabeta Scintillation Counter, is used. In order to obtain most accurate results, the instruction manual for optimum operation of the particular scintillation counter should be followed. For example, for the LKB 1210 Ultrabeta Scintillation Counter, the following procedure should be followed. The swatch to be measured is put into a plastic vial filled with 12 ml of scintillator liquid (e.g. scintillator 299 from Packard). The swatch is then allowed to stabilize for at least 30 minutes. The vial is then put into the LKB 1210 Ultrabeta Scintillation Counter and the respective radio-activity counts for the swatch is obtained.

In order to measure the amount of CMC removal due only to the cellulase, a measurement of a swatch which has been inoculated at the same time but has been treated in the laundry test solution without cellulase, is necessary. The activity of the cellulase is then expressed as percent of radio-active labelled CMC removal. This percentage is calculated by the following formula $$\% \text{ of radio-active } CMC \text{ removal} = \frac{XO - XC}{XO} \times 100$$

Wherein

XO is the radioactivity scintillation count of a swatch treated with the laundry test solution without cellulase XC is the radioactivity scintillation count of a swatch treated with the laundry test solution containing the cellulase to be evaluated Statistical considerations, procedure confirmation:

In order to provide statistically sound results, standard statistical analysis should be employed. For the given example, using the LKB 1210 Ultrabeta Scintillation Counter, it has been found that a sample size of 3 swatches for each radioactivity scintillation count can be used.

In order to confirm the procedure by internal crosschecking, measurement and calculation of the "blank sample" according to EP-A-350098 are recommended. This will allow to detect and eliminate errors.

Interpretation of results:

The described screening test does provide a fast, unique and reliable method to identify cellulases which satisfy the activity criteria of the present invention versus cellulases which are not part of the present invention.

It has been found that a removal of 10% or more of the immobilized radioactive labelled CMC according to the above C14CMC-method, indicates that the respective cellulase satisfies the requirements of the invention.

It will be obvious to those skilled in the art that removal percentages above 10% indicate a higher activity for the respective cellulase. It therefore is contemplated that cellulase providing above 25% or preferably above 50% removal of radioactive labelled CMC, at the protein concentration in the laundry test solution according to the C14CMC-method, would provide indication of an even better performance of the cellulase for use in laundry detergents.

It also has been contemplated that usage of higher concentrations of cellulase for C14CMC-method, would provide higher removal percentages. However, there exists no linear proven correlation between cellulase concentration and removal percentage obtained by it.

It also has been contemplated that usage of higher concentrations of cellulase for C14CMC-method, would provide higher removal percentages.

TABLE I

| Radioactive $C_{14}$ labelled CMC stock solution (all percentages by weight of total solution) | |
|---|---|
| Total CMC* (CMC should be detergent grade CMC with a degree of substitution from about 0.47 to about 0.7) | $99.2 \times 10^{-3}\%$ |
| Ethanol | $14985.12 \times 10^{-3}\%$ |
| Deionized Water | $84915.68 \times 10^{-3}\%$ |
| Total: | 100% |

*Total CMC contains non-radio-active and radio-active CMC to provide a radio-activity which allows sufficiently clear readings on the scintillation counter used. For example, the radio-active CMC can have an activity of 0.7 millicurie/g and be mixed with non-radio-active CMC at a ratio of 1:6.7.

TABLE II

| Laundry test solution (all percentages by weight of total solution) | |
|---|---|
| Linear $C_{12}$ alkyl benzene sulphonic acid | 0.110% |
| Coconut alkyl sulphate (TEA salt) | 0.040% |
| $C_{12-15}$ alcohol ethoxylate (E07) | 0.100% |
| Coconut fatty acid | 0.100% |
| Oleic acid | 0.050% |
| Citric acid | 0.010% |
| Triethanolamine | 0.040% |
| Ethanol | 0.060% |
| Propanediol | 0.015% |
| Sodium hydroxide | 0.030% |
| Sodium formate | 0.010% |
| Protease | 0.006% |
| Water (2.5 mmol/liter $Ca^{++}$), pH adjustment agent (HCL or NaOH solutions) and cellulase | balance to 100% |

It should be stressed that all cellulase enzymes according to the present invention have to meet the criteria of the above mentioned screening test. However, in the Danish Patent Application 1159/90 additional criteria are established allowing to identify preferred cellulase enzymes in combination with present screening test.

Cellulase preparations particularly useful in the compositions of the invention are those in which in addition to the screening test, the endoglucanase component exhibits a CMC-endoase activity of at least about 50, preferably at least about 60, in particular at least about 90 CMC-endoase units per mg of total protein. In particular, a preferred endoglucanase component exhibits a CMC-endoase activity of at least 100 CMC-endoase units per mg of total protein.

In the present context, the term "CMC-endoase activity" (cevu) refers to the endoglucanase activity of the endoglucanase component in terms of its ability to degrade cellulose to glucose, cellobiose and triose, as determined by a viscosity decrease of a solution of carboxymethyl cellulose (CMC) after incubation with the cellulase preparation of the invention, as described in detail below.

The CMC-endoase (endoglucanase) activity can be determined from the viscosity decrease of CMC, as follows:

A substrate solution is prepared, containing 35 g/l CMC Blanose 7LFD (Aqualun) in 0.1M tris buffer at pH 9.0. The enzyme sample to be analyzed is dissolved in the same buffer. 10 ml substrate solution and 0.5 ml enzyme solution are mixed and transferred to a viscosimeter (e.g. Haake VT 181, NV sensor, 181 r.p.m.), thermostated at 40° C. Viscosity readings are taken as soon as possible after mixing and again 30 minutes later. The amount of enzyme that reduces the viscosity to one half under these conditions is defined as 1 unit of CMC-endoase activity.

SDS polyacrylamide gel electrophoresis (SDS-PAGE) and isoelectric focusing with marker proteins in a manner known to persons skilled in the art were used to determine the molecular weight and isolelectric point (pI), respectively, of the endoglucanase component in the cellulase preparation useful in the present context. In this way, the molecular weight of a specific endoglucanase component was determined to be 43 kD. The isoelectric point of this endoglucanase was determined to be about 5.1.

The cellobiohydrolase activity may be defined as the activity towards cellobiose p-nitrophenyl. The activity is determined as mmole nitrophenyl released per minute at 37° C. and pH 7.0. The present endoglucanase component was found to have essentially no cellobiohydrolase activity.

The endoglucanase component in the cellulase preparation herein has initially been isolated by extensive purification procedures, i.a. involving reverse phase HPLC purification of a crude *H. insolens* cellulase mixture according to U.S. Pat. No. 4,435,307. This procedure has surprisingly resulted in the isolation of a 43kD endoglucanase as a single component with unexpectedly favourable properties due to a surprisingly high endoglucanase activity.

Also, in addition to the screening test, the cellulase enzymes useful in the present compositions can further be defined as enzymes exhibiting endoglucanase activity (in the following referred to as an "endoglucanase enzyme"), which enzymes have the amino acid sequence shown in the appended Sequence Listing ID#2, or a homologue thereof exhibiting endoglucanase activity.

In the present context, the term "homologue" is intended to indicate a polypeptide encoded by DNA which hybridizes to the same probe as the DNA coding for the endoglucanase enzyme with this amino acid sequence under certain specified conditions (such as presoaking in 5×SSC and prehybridizing for 1 h at 40° C. in a solution of 20% formamide, 5×Denhardt's solution, 50 mM sodium phosphate, pH 6.8, and 50 ug of denatured sonicated calf thymus DNA, followed by hybridization in the same solution supplemented with 100 mM ATP for 18 h at 40° C.). The term is intended to include derivatives of the aforementioned sequence obtained by addition of one or more amino acid residues to either or both the C- and N-terminal of the native sequence, substitution of one or more amino acid residues at one or more sites in the native sequence, deletion of one or more amino acid residues at either or both ends of the native amino acid sequence or at one or more sites within the native sequence, or insertion of one or more amino acid residues at one or more sites in the native sequence.

The endoglucanase enzyme herein may be one producible by species of Humicola such as *Humicola insolens* e.g. strain DSM 1800, deposited on Oct. 1, 1981 at the Deutsche Sammlung von Mikroorganismen, Mascheroder Weg 1B, D-3300 Braunschweig, FRG, in accordance with the provisions of the Budapest Treaty on the International Recognition of the Deposit of Microorganisms for the Purposes of Patent Procedure (the Budapest Treaty).

In still a further aspect, the cellulase enzymes useful herein can be defined, in addition to the screening test, as endoglucanase enzymes which have the amino acid sequence shown in the appended Sequence Listing ID#4, or a homologue thereof (as defined above) exhibiting endoglucanase activity. Said endoglucanase enzyme may be one producible by a species of Fusarium, such as *Fusarium oxysporum*, e.g. strain DSM 2672, deposited on Jun. 6, 1983 at the Deutsche Sammlung von Mikroorganismen, Mascheroder Weg 1B, D-3300 Braunschweig, FRG, in accordance with the provisions of the Budapest Treaty.

Furthermore, it is contemplated that homologous endoglucanases may be derived from other microorganisms producing cellulolytic enzymes, e.g. species of Trichoderma, Myceliophthora, Phanerochaete, Schizophyllum, Penicillium, Aspergillus, and Geotricum.

In yet a further aspect, the cellulase enzymes useful herein can be defined, as endoglucanase, preferably originating from Humicola Insolens, although other fungi and bacteria can be used in order to produce said endoglucanase. Said endoglucanase has a molecular weight of about 50 KDa, an iso-electric point of 5.5 and contains 415 amino acids. The amino acid sequence coding is as shown in the appended sequence listing ID#5. Without being specifically incorporated into the claims, it is self evident that one or more of the amino acids in the sequence can be replaced by other amino acids or amino acid analogues or derivatives. Also deletions and/or substitutions or insertions of one or more amino acids in the sequence are incorporated herein.

For industrial production of the cellulase preparation herein, however, it is preferred to employ recombinant DNA techniques or other techniques involving adjustments of fermentations or mutation of the microorganisms involved to ensure overproduction of the desired enzymatic activities. Such methods and techniques are known in the art and may readily be carried out by persons skilled in the art.

The endoglucanase component may thus be one which is producible by a method comprising cultivating a host cell transformed with a recombinant DNA vector which carries a DNA sequence encoding said endoglucanase component or a precursor of said endoglucanase component as well as DNA sequences encoding functions permitting the expression of the DNA sequence encoding the endoglucanase component or precursor thereof, in a culture medium under conditions permitting the expression of the endoglucanase component or precursor thereof and recovering the endoglucanase component from the culture.

DNA constructs comprising a DNA sequence encoding an endoglucanase enzyme as described above, or a precursor form of the enzyme, include the DNA constructs having a DNA sequence as shown in the appended Sequence Listings ID#1 or ID#3, or a modification thereof. Examples of suitable modifications of the DNA sequence are nucleotide substitutions which do not give rise to another amino acid sequence of the endoglucanase, but which correspond to the codon usage of the host organism into which the DNA construct is introduced or nucleotide substitutions which do give rise to a different amino acid sequence and therefore, possibly, a different protein structure which might give rise to an endoglucanase mutant with different properties than the native enzyme. Other examples of possible modifications are insertion of one or more nucleotides at either end of the sequence, or deletion of one or more nucleotides at either end or within the sequence.

DNA constructs encoding endoglucanase enzymes useful herein may be prepared synthetically by established standard methods, e.g. the phosphoamidite method described by S. L. Beaucage and M. H. Caruthers, *Tetrahedron Letters* 22, 1981, pp. 1859–1869, or the method described by Matthes et al., *EMBO Journal* 3, 1984, pp. 801–805. According to the phosphoamidite method, oligonucleotides are synthesized, e.g. in an automatic DNA synthesizer, purified, annealed, ligated and cloned in suitable vectors.

A DNA construct encoding the endoglucanase enzyme or a precursor thereof may, for instance, be isolated by establishing a cDNA or genomic library of a cellulase-producing microorganism, such as *Humicola insolens*, DSM 1800, and screening for positive clones by conventional procedures such as by hybridization using oligonucleotide probes synthesized on the basis of the full or partial amino acid sequence of the endoglucanase in accordance with standard techniques (cf. Sambrook et al., *Molecular Cloning: A Laboratory Manual,* 2and. Ed. Cold Spring Harbor, 1989), or by selecting for clones expressing the appropriate enzyme activity (i.e. CMC-endoase activity as defined above), or by selecting for clones producing a protein which is reactive with an antibody against a native cellulase (endoglucanase).

Finally, the DNA construct may be of mixed synthetic and genomic, mixed synthetic and cDNA or mixed genomic and cDNA origin prepared by ligating fragments of synthetic, genomic or cDNA origin (as appropriate), the fragments corresponding to various parts of the entire DNA construct, in accordance with standard techniques. The DNA construct may also be prepared by polymerase chain reaction using specific primers, for instance as described in U.S. Pat. No. 4,683,202 or R. K. Saiki et al., *Science* 239, 1988, pp. 487–491.

Recombinant expression vectors into which the above DNA constructs are inserted include any vector which may conveniently be subjected to recombinant DNA procedures, and the choice of vector will often depend on the host cell into which it is to be introduced. Thus, the vector may be an autonomously replicating vector, i.e. a vector which exists as an extrachromosomal entity, the replication of which is independent of chromosomal replication, e.g. a plasmid. Alternatively, the vector may be one which, when introduced into a host cell, is integrated into the host cell genome and replicated together with the chromosome(s) into which it has been integrated.

In the vector, the DNA sequence encoding the endoglucanase should be operably connected to a suitable promoter and terminator sequence. The promoter may be any DNA sequence which shows transcriptional activity in the host cell of choice and may be derived from genes encoding proteins either homologous or heterologous to the host cell. The procedures used to ligate the DNA sequences coding for the endoglucanase, the promoter and the terminator, respectively, and to insert them into suitable vectors are well known to persons skilled in the art (cf., for instance, Sambrook et al., op.cit.).

Host cells which are transformed with the above DNA constructs or the above expression vectors may be for instance belong to a species of Aspergillus, most preferably *Aspergillys oryzae* or *Aspergillus niger*. Fungal cells may be transformed by a process involving protoplast formation and transformation of the protoplasts followed by regeneration of the cell wall in a manner known per se. The use of Aspergillus as a host microorganism is described in EP 238 023 (of Novo Industri A/S), the contents of which are hereby incorporated by reference. The host cell may also be a yeast cell, e.g. a strain of *Saccharomyces cerevisiae*.

Alternatively, the host organism may be a bacterium, in particular strains of Streptomyces and Bacillus, and *E. coli*. The transformation of bacterial cells may be performed according to conventional methods, e.g. as described in Sambrook et al., *Molecular Cloning: A Laboratory Manual*, Cold Spring Harbor, 1989.

The screening of appropriate DNA sequences and construction of vectors may also be carried out by standard procedures, cf. Sambrook et al., op.cot.

The medium used to cultivate the transformed host cells may be any conventional medium suitable for growing the host cells in question. The expressed endoglucanase may conveniently be secreted into the culture medium and may be recovered therefrom by well-known procedures including separating the cells from the medium by centrifugation or filtration, precipitating proteinaceous components of the medium by means of a salt such as ammonium sulphate, followed by chromatographic procedures such as ion exchange chromatography, affinity chromatography, or the like.

By employing recombinant DNA techniques as indicated above, techniques of protein purification, techniques of fermentation and mutation or other techniques which are well known in the art, it is possible to provide endoglucanases of a high purity.

The level in the present composition of cellulase described above should be such that the amount of enzyme protein to be delivered in the wash solution is from 0.005 to 40 mg/liter of wash solution, preferably 0.01 to 10 mg/liter of wash solution.

The cellulase added to the composition of the invention may be in the any form, for instance, non-dusting granulate, e.g. "marumes" or "prills", or in the form of a liquid in which the cellulase is provided as a cellulase concentrate suspended in e.g. a nonionic surfactant or dissolved in an aqueous medium, having cellulase activity of at least 250 regular $C_x$ cellulase activity units/gram, measured under standard conditions as described in GB 2 075 028 A.

The amount of cellulase added to the composition of the invention will, in general, be from about 0.01 to 10% by weight in whatever form. In terms of the cellulase activity the use of cellulase in an amount corresponding to from 0.25 to 150 or higher regular $C_x$ units/gram of the detergent composition is within the preferred scope of the invention. A most preferred range of the cellulase activity, however, is from 0.5 to 25 regular $C_x$ units/gram of the detergent composition.

The Anionic Surfactant

Suitable anionic surface-active salts are selected from the group of sulphonates and sulfates. The like anionic surfactants are well-known in the detergent art and have found wide application in commercial detergents. Preferred anionic water-soluble sulphonate or sulfate salts have in their molecular structure an alkyl radical containing from about 8 to about 22 carbon atoms. Examples of such preferred anionic surfactant salts are the reaction products obtained by sulfating $C_8$–$C_{18}$ fatty alcohols derived from e.g. tallow oil, palm oil, palm kernel oil and coconut oil; alkylbenzene sulphonates wherein the alkyl group contains from about 9 to about 15 carbon atoms; sodium alkylglyceryl ether sulphonates; ether sulfates of fatty alcohols derived from tallow and coconut oils; coconut fatty acid monoglyceride sulfates and sulphonates; and water-soluble salts of paraffin sulphonates having from about 8 to about 22 carbon atoms in the alkyl chain. Sulphonated olefin surfactants as more fully described in e.g. U.S. Pat. No. 3,332,880 can also be used. The neutralizing cation for the anionic synthetic sulphonates and/or sulfates is represented by conventional cations which are widely used in detergent technology such as sodium, potassium or alkanolammonium.

A suitable anionic synthetic surfactant component herein is represented by the water-soluble salts of an alkylbenzene sulphonic acid, preferably sodium alkylbenzene sulphonates, preferably sodium alkylbenzene sulphonates having from about 10 to 13 carbon atoms in the alkyl group. Another preferred anionic surfactant component herein is sodium alkyl sulfates having from about 10 to 15 carbon atoms in the alkyl group.

Another anionic surfactant suitable for use herein can be alkyl alkoxylated sulphate surfactants. Alkyl alkoxylated sulphate surfactants hereof are water soluble salts or acids of the formula $RO(A)_mSO_3M$ wherein R is an unsubstituted $C_{10}$–$C_{24}$ alkyl or hydroxylalkyl group having a $C_{10}$–$C_{24}$ alkyl component, preferably a $C_{12}$–$C_{18}$ alkyl or hydroxylalkyl, A is an ethoxy or propoxy unit, m is greater than zero, typically between about 0.5 and about 6, more preferably between about 0.5 and 3, and M is H or a cation which can be for example a metal cation (e.g. sodium, potassium, lithium, calcium, magnesium, etc.), ammonium or substituted-ammonium cation. Alkyl ethoxylated sulphates as well as alkyl propoxylated sulphates are contemplated herein. Specific examples of substituted ammonium cations include methyl-, dimethyl, trimethyl-ammonium cations and quaternary ammonium cations such as tetramethylammonium and dimethyl piperdinium cations and those derived from alkylamines such as ethylamine, diethylamine, triethylamine mixtures thereof, and the like. Exemplary surfactants are $C_{12}$–$C_{18}$ alkyl polyethoxylate (1.0) sulphate ($C_{12}$–$C_{18}$E(1.0)M), $C_{12}$–$C_{18}$ alkyl polyethoxylate (2.25) sulphate ($C_{12}$–$C_{18}$E(2.25)M), $C_{12}$–$C_{18}$ alkyl polyethoxylate (3.0) sulphate ($C_{12}$–$C_{18}$E(3.0)M), $C_{12}$–$C_{18}$ alkyl polyethoxylate (4.0) sulphate ($C_{12}$–$C_{18}$E(4.0)M), wherein M is conveniently selected from sodium and potassium.

The compositions according to the present invention comprise from 1% to 50% by weight of the total composition of said anionic surfactant or mixtures thereof, preferably from 1% to 30%, most preferably from 5% to 15%.

The rest of the liquid detergent composition according to the present invention is made of conventional detergency ingredients, i.e. water, surfactants, builders and others.

The liquid detergent compositions herein may additionally comprise as an optional ingredient from 0.5% to 50% by weight of the total liquid detergent composition, preferably from 5% to 25% by weight of an organic surface-active agent selected from nonionic, cationic and zwitterionic surface-active agents and mixtures thereof.

The nonionic surfactants suitable for use herein include those produced by condensing ethylene oxide with a hydrocarbon having a reactive hydrogen atom, e.g., a hydroxyl, carboxyl, or amido group, in the presence of an acidic or basic catalyst, and include compounds having the general formula $RA(CH_2CH_2O)_nH$ wherein R represents the hydrophobic moiety, A represents the group carrying the reactive hydrogen atom and n represents the average number of ethylene oxide moieties. R typically contains from about 8 to 22 carbon atoms. They can also be formed by the condensation of propylene oxide with a lower molecular weight compound. n usually varies from about 2 to about 24.

A preferred class of nonionic ethoxylates is represented by the condensation product of a fatty alcohol having from 12 to 15 carbon atoms and from about 4 to 10 moles of ethylene oxide per mole or fatty alcohol. Suitable species of this class of ethoxylates include : the condensation product of $C_{12}$–$C_{15}$ oxo-alcohols and 3 to 9 moles of ethylene oxide per mole of alcohol; the condensation product or narrow cut $C_{14}$–$C_{15}$ oxo-alcohols and 3 to 9 moles of ethylene oxide per mole of fatty(oxo)alcohol; the condensation product of a narrow cut $C_{12}$–$C_{13}$ fatty(oxo)alcohol and 6,5 moles of ethylene oxide per mole of fatty alcohol; and the condensation products of a $C_{10}$–$C_{14}$ $C_{14}$ coconut fatty alcohol with a degree of ethoxylation (moles EO/mole fatty alcohol) in the range from 4 to 8. The fatty oxo alcohols while mainly linear can have, depending upon the processing conditions and raw material olefins, a certain degree of branching, particularly short chain such as methyl branching. A degree of branching in the range from 15% to 50% (weight%) is frequently found in commercial oxo alcohols. The compositions according to the present invention contain from 0.5% to 50% by weight of the total composition, preferably from 2% to 25% of nonionic surfactants.

An optional surfactant for use herein are cationic surfactants. Suitable cationic surfactants include quaternary ammonium compounds of the formula $R_1R_2R_3R_4N^+$ where $R_1$,$R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group. The compositions according to the present invention contain from 0.5% to 10% by weight of the total composition, preferably from 1% of 5% of cationic surfactants.

Another optional ingredient are zwitterionic surfactants. Zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulphonates and sulfates disclosed in U.S. Pat. No. 3,925,262, Laughlin et al., and U.S. Pat. No. 3,929,678, Laughlin et al. Compositions according to the present invention contain from 0.5% to 25% by weight of the total composition, preferably from 2% to 10% of zwitterionic surfactants.

Semi-polar nonionic surfactants include water-soluble amine oxides containing one alkyl or hydroxy alkyl moiety of from about 8 to about 28 carbon atoms and two moieties selected from the group consisting of alkyl groups and hydroxy alkyl groups, containing from 1 to about 3 carbon atoms which can optionally be joined into ring structures.

Also suitable are Poly hydroxy fatty acid amide surfactants of the formula,

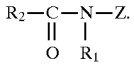

wherein $R^1$ is H, $C_{1-4}$ hydrocarbyl, 2-hydroxy ethyl, 2-hydroxy propyl or a mixture thereof, $R_2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R_1$ is methyl, $R_2$ is a straight $C_{11-15}$ alkyl or alkenyl chain or mixtures thereof, and Z is derived from a reducing sugar such as glucose, fructose, maltose, lactose, in a reductive amination reaction. Compositions comprise from 1% to 25%, preferably from 5% to 15% of poly hydroxy fatty acid amide surfactants.

The compositions according to the present invention may further comprise a builder system. Any conventional builder system is suitable for use herein including polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R_CH(COOH) $CH_2$(COOH) wherein R is $C_{10-20}$ alkyl or alkenyl, preferably $C_{12-16}$, or wherein R can be substituted with hydroxyl, sulpho sulphoxyl or sulphone substitutents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium. ammonium and alkanolammonium salts.

Other suitable polycarboxylates are oxodisuccinates and mixtures of tartrate monosuccinic and tartrate disuccinic acid such as described in U.S. Pat. No. 4,663,071.

Suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described herein above.

The builder system according to the present invention preferably represents from 5% to 35% by weight of the total composition, preferably from 5% to 25%, most preferably from 8% to 20%.

The compositions according to the present invention may comprise from 0.01 % to 10% by weight of the total composition, preferably from 0.1% to 5%, most preferably from 0.5% to 2% of additional enzymes, i.e. other than cellulases.

Suitable enzymes for use herein are protease, lipases and amylases and mixtures thereof. Preferred additional enzymes for use herein are proteases. Suitable proteases include proteases of animal, vegetable or microorganism origin. More preferred are proteases of bacterial origin, most preferably bacterial serine protease obtained from *Bactillus subtilis* and/or *Bactillus lichenformis*.

Suitable commercially available proteases include Novo Industri A/S Alcalase$^R$, Esperase$^R$, Savinas$^R$, (Copenhagen, Denmark), Gist-brocades' Maxatase$^R$, Maxacal$^R$ and Maxapem 15$^R$ (protein engineered Maxacal$^R$) (Delft, Netherlands) and substilisin BPN and BNP'. Preferred proteases are also modified bacterial serine proteases, such as those made by Genencor International Inc. (San Francisco, Calif.) which are described in the European Patent Application Serial Number 87303761.8 filed Apr. 28, 1987 (particularly pages 17, 24 and 98), and which is called herein "Protease B" and 199 404, Venegas, published Oct. 29, 1986, which refers to a modified bacterial serine protease (Grenencor International) which is called "Protease A" herein, (same as BNP'). Preferred proteases are thus selected from the group consisting of Alcanase$^R$ (Novo Industri A/S), BNP', Protease A and Protease B (Grenencor), and mixtures thereof. The most preferred protease for use herein is Protease B.

The compositions herein can contain a series of further, optional ingredients. Examples of the like additives include solvents, alkanolamines, pH adjusting agents, suds regulants, opacifiers, agents to improve the machine compatibility in relation to enamel-coated surfaces, perfumes, dyes, bactericides, brighteners, soil release agents, softening agents and the like.

The compositions according to the present invention can be formulated as conventional liquid detergent compositions or, as an alternative as so-called "concentrated" liquid detergent compositions, i.e. liquid detergent compositions comprising less than 30% of water.

According to the present invention the storage stability of the cellulase in the compositions can be evaluated by a number of methods which are based on the real remaining performance of the cellulase after storage and use solid cellulose substrates.

One such method can be a small scale performance test method. According to this method the depilling of pre-aged flannel cotton due to cellulase activity is measured.

Another such method can be a performance predictive analytical method using solid cotton linters as substrate. According to this method the reducing sugar release is measured.

Other methods involve the measurement of cellulase activity by the observation of the viscosity decrease of a CMC solution or measurement of the reducing sugars released in solution due to degradation of soluble cellulose substrates. Since it is cellulase adsorption onto solid substrate which determines the performance, methods based on soluble cellulose substrates are not suitable to determine the cellulase stability according to the present invention.

EXAMPLES

The following examples are made by combining the following ingredients in the listed proportions.

Examples of Compositions of Liquid Detergents with Hydrophobic Amines

| Composition in % | Ref | A | B | C | D | E | Ref | F | G | Ref | H | I | J |
|---|---|---|---|---|---|---|---|---|---|---|---|---|---|
| Water and minors | balance to 100 | | | balance to 100 | | | | balance to 100 | | | | | |
| Linear C12 alkyl benzene sulphonate | 7 | 7 | 7 | 7 | 7 | 7 | 0 | 0 | 0 | 0 | 0 | 0 | 0 |
| C12–15 alkyl sulphate | 0 | 0 | 0 | 0 | 0 | 0 | 16 | 16 | 16 | 0 | 0 | 0 | 0 |
| C12–15 alkyl sulphate + 3 mole ethylene oxide | 9 | 9 | 9 | 9 | 9 | 9 | 3 | 3 | 3 | 23 | 23 | 23 | 23 |
| C12–14 alkyl glucoside | 0 | 0 | 0 | 0 | 0 | 0 | 7 | 7 | 7 | 9 | 9 | 9 | 9 |
| C12–15 alcohol + 7 mole ethylene oxide | 9 | 9 | 9 | 9 | 9 | 9 | 5 | 5 | 5 | 6 | 6 | 6 | 6 |
| C12–18 fatty acids | 2 | 2 | 2 | 2 | 2 | 2 | 10 | 10 | 10 | 9 | 9 | 9 | 9 |
| Citric acid anhydrous | 3 | 3 | 3 | 3 | 3 | 3 | 3 | 3 | 3 | 6 | 6 | 6 | 6 |
| C12–14 alkenyl succinate | 10 | 10 | 10 | 10 | 10 | 10 | 0 | 0 | 0 | 0 | 0 | 0 | 0 |
| DTPMP or DTPA | 0.7 | 0.7 | 0.7 | 0.7 | 0.7 | 0.7 | 1.5 | 1.5 | 1.5 | 1.0 | 1.0 | 1.0 | 1.0 |
| Sodiumhydroxide (to pH 7.5–8.0) | 7 | 5 | 5 | 5 | 5 | 5 | 0 | 0 | 0 | 0 | 0 | 0 | 0 |
| Mono ethanol amine (to pH 7.5–8.0) | 0 | 0 | 0 | 0 | 0 | 0 | 10 | 8 | 7 | 14 | 13 | 12 | 13 |
| Ethanol | 4 | 4 | 4 | 4 | 4 | 4 | 0 | 0 | 0 | 2 | 2 | 2 | 2 |
| Propanediol | 2 | 2 | 2 | 2 | 2 | 2 | 18 | 18 | 18 | 12 | 12 | 12 | 12 |
| Boric acid | 1 | 1 | 1 | 1 | 1 | 1 | 3 | 3 | 3 | 2 | 2 | 2 | 2 |
| Protease | 0.3 | 0.3 | 0.3 | 0.3 | 0.3 | 0.3 | 0.5 | 0.5 | 0.5 | 0.5 | 0.5 | 0.5 | 0.5 |
| Cellulase-Carezyme(TM) | 1 | 1 | 1 | 1 | 1 | 1 | 1 | 1 | 1 | 1 | 1 | 1 | 1 |
| Hydrophobic amine: | | | | | | | | | | | | | |
| n-butyl amine | 0 | 1.5 | 0 | 0 | 0 | 0 | 0 | 0 | 0 | 0 | 0 | 0 | 0 |
| n-hexyl amine | 0 | 0 | 2.1 | 0 | 0 | 0 | 0 | 2.1 | 5 | 0 | 2 | 5 | 0 |
| n-octyl amine | 0 | 0 | 0 | 2.6 | 0 | 0 | 0 | 0 | 0 | 0 | 0 | 0 | 0 |
| cyclo hexyl amine | 0 | 0 | 0 | 0 | 2 | 0 | 0 | 0 | 0 | 0 | 0 | 0 | 2.1 |
| dodecyl trimethyl ammonium chloride | 0 | 0 | 0 | 0 | 0 | 5.5 | 0 | 0 | 0 | 0 | 0 | 0 | 0 |
| Cellulase stability: | | | | | | | | | | | | | |
| % cellulase left after 1 week storage at constant 35° C. | 37 | 82 | 82 | 80 | 84 | 70 | 30 | 50 | 60 | 40 | 58 | 79 | 60 |

SEQUENCE LISTING ( 1 ) GENERAL INFORMATION:

( i i i ) NUMBER OF SEQUENCES: 5

( 2 ) INFORMATION FOR SEQ ID NO:1:

( i ) SEQUENCE CHARACTERISTICS:
( A ) LENGTH: 1060 base pairs
( B ) TYPE: nucleic acid
( C ) STRANDEDNESS: single
( D ) TOPOLOGY: linear ( i i ) MOLECULE TYPE: cDNA ( i i i ) HYPOTHETICAL: NO ( i v ) ORIGINAL SOURCE:
( A ) ORGANISM: Humicola insolens
( B ) STRAIN: DSM 1800

( i x ) FEATURE:
( A ) NAME/KEY: mat peptide
( B ) LOCATION: 73.927

( i x ) FEATURE:
( A ) NAME/KEY: sig peptide
( B ) LOCATION: 10.72

( i x ) FEATURE:
( A ) NAME/KEY: CDS
( B ) LOCATION: 10.927

( x i ) SEQUENCE DESCRIPTION: SEQ ID NO:1:

```
GGAT CCAAG   ATG CGT TCC TCC CCC CTC CTC CCG TCC GCC GTT GTG GCC      48
             Met Arg Ser Ser Pro Leu Leu Pro Ser Ala Val Val Ala
             -21 -20                 -15                     -10

GCC CTG CCG GTG TTG GCC CTT GCC GCT GAT GGC AGG TCC ACC CGC TAC      96
Ala Leu Pro Val Leu Ala Leu Ala Ala Asp Gly Arg Ser Thr Arg Tyr
            -5                  1               5

TGG GAC TGC TGC AAG CCT TCG TGC GGC TGG GCC AAG AAG GCT CCC GTG     144
Trp Asp Cys Cys Lys Pro Ser Cys Gly Trp Ala Lys Lys Ala Pro Val
    10                  15                      20

AAC CAG CCT GTC TTT TCC TGC AAC GCC AAC TTC CAG CGT ATC ACG GAC     192
Asn Gln Pro Val Phe Ser Cys Asn Ala Asn Phe Gln Arg Ile Thr Asp
25                  30                      35                  40

TTC GAC GCC AAG TCC GGC TGC GAG CCG GGC GGT GTC GCC TAC TCG TGC     240
Phe Asp Ala Lys Ser Gly Cys Glu Pro Gly Gly Val Ala Tyr Ser Cys
                45                      50                  55

GCC GAC CAG ACC CCA TGG GCT GTG AAC GAC GAC TTC GCG CTC GGT TTT     288
Ala Asp Gln Thr Pro Trp Ala Val Asn Asp Asp Phe Ala Leu Gly Phe
            60                      65                  70

GCT GCC ACC TCT ATT GCC GGC AGC AAT GAG GCG GGC TGG TGC TGC GCC     336
Ala Ala Thr Ser Ile Ala Gly Ser Asn Glu Ala Gly Trp Cys Cys Ala
        75                      80                  85

TGC TAC GAG CTC ACC TTC ACA TCC GGT CCT GTT GCT GGC AAG AAG ATG     384
Cys Tyr Glu Leu Thr Phe Thr Ser Gly Pro Val Ala Gly Lys Lys Met
    90                  95                      100

GTC GTC CAG TCC ACC AGC ACT GGC GGT GAT CTT GGC AGC AAC CAC TTC     432
Val Val Gln Ser Thr Ser Thr Gly Gly Asp Leu Gly Ser Asn His Phe
105                 110                     115                 120

GAT CTC AAC ATC CCC GGC GGC GGC GTC GGC ATC TTC GAC GGA TGC ACT     480
Asp Leu Asn Ile Pro Gly Gly Gly Val Gly Ile Phe Asp Gly Cys Thr
                125                     130                 135

CCC CAG TTC GGC GGT CTG CCC GGC CAG CGC TAC GGC GGC ATC TCG TCC     528
Pro Gln Phe Gly Gly Leu Pro Gly Gln Arg Tyr Gly Gly Ile Ser Ser
```

-continued

```
                140                     145                     150

CGC AAC GAG TGC GAT CGG TTC CCC GAC GCC CTC AAG CCC GGC TGC TAC      576
Arg Asn Glu Cys Asp Arg Phe Pro Asp Ala Leu Lys Pro Gly Cys Tyr
            155                 160                 165

TGG CGC TTC GAC TGG TTC AAG AAC GCC GAC AAT CCG AGC TTC AGC TTC      624
Trp Arg Phe Asp Trp Phe Lys Asn Ala Asp Asn Pro Ser Phe Ser Phe
        170                 175                 180

CGT CAG GTC CAG TGC CCA GCC GAG CTC GTC GCT CGC ACC GGA TGC CGC      672
Arg Gln Val Gln Cys Pro Ala Glu Leu Val Ala Arg Thr Gly Cys Arg
185                 190                 195                 200

CGC AAC GAC GAC GGC AAC TTC CCT GCC GTC CAG ATC CCC TCC AGC AGC      720
Arg Asn Asp Asp Gly Asn Phe Pro Ala Val Gln Ile Pro Ser Ser Ser
                205                 210                 215

ACC AGC TCT CCG GTC AAC CAG CCT ACC AGC ACC AGC ACC ACG TCC ACC      768
Thr Ser Ser Pro Val Asn Gln Pro Thr Ser Thr Ser Thr Thr Ser Thr
            220                 225                 230

TCC ACC ACC TCG AGC CCG CCA GTC CAG CCT ACG ACT CCC AGC GGC TGC      816
Ser Thr Thr Ser Ser Pro Pro Val Gln Pro Thr Thr Pro Ser Gly Cys
        235                 240                 245

ACT GCT GAG AGG TGG GCT CAG TGC GGC GGC AAT GGC TGG AGC GGC TGC      864
Thr Ala Glu Arg Trp Ala Gln Cys Gly Gly Asn Gly Trp Ser Gly Cys
    250                 255                 260

ACC ACC TGC GTC GCT GGC AGC ACT TGC ACG AAG ATT AAT GAC TGG TAC      912
Thr Thr Cys Val Ala Gly Ser Thr Cys Thr Lys Ile Asn Asp Trp Tyr
265                 270                 275                 280

CAT CAG TGC CTG TAGACGCAGG GCAGCTTGAG GGCCTTACTG GTGGCCGCAA          964
His Gln Cys Leu

CGAAATGACA CTCCCAATCA CTGTATTAGT TCTTGTACAT AATTTCGTCA TCCCTCCAGG   1024

GATTGTCACA TAAATGCAAT GAGGAACAAT GAGTAC                             1060
```

( 2 ) INFORMATION FOR SEQ ID NO:2:

( i ) SEQUENCE CHARACTERISTICS:
( A ) LENGTH: 305 amino acids
( B ) TYPE: amino acid
( C ) TOPOLOGY: linear ( i i ) MOLECULE TYPE: protein ( x i ) SEQUENCE DESCRIPTION: SEQ ID NO:2:

```
Met Arg Ser Ser Pro Leu Leu Pro Ser Ala Val Val Ala Ala Leu Pro
-21 -20                 -15                 -10

Val Leu Ala Leu Ala Ala Asp Gly Arg Ser Thr Arg Tyr Trp Asp Cys
-5                  1               5                   10

Cys Lys Pro Ser Cys Gly Trp Ala Lys Lys Ala Pro Val Asn Gln Pro
            15                  20                  25

Val Phe Ser Cys Asn Ala Asn Phe Gln Arg Ile Thr Asp Phe Asp Ala
        30                  35                  40

Lys Ser Gly Cys Glu Pro Gly Gly Val Ala Tyr Ser Cys Ala Asp Gln
    45                  50                  55

Thr Pro Trp Ala Val Asn Asp Asp Phe Ala Leu Gly Phe Ala Ala Thr
60                  65                  70                  75

Ser Ile Ala Gly Ser Asn Glu Ala Gly Trp Cys Cys Ala Cys Tyr Glu
                80                  85                  90

Leu Thr Phe Thr Ser Gly Pro Val Ala Gly Lys Lys Met Val Val Gln
            95                  100                 105

Ser Thr Ser Thr Gly Gly Asp Leu Gly Ser Asn His Phe Asp Leu Asn
        110                 115                 120
```

-continued

```
Ile Pro Gly Gly Gly Val Gly Ile Phe Asp Gly Cys Thr Pro Gln Phe
    125                 130                 135

Gly Gly Leu Pro Gly Gln Arg Tyr Gly Gly Ile Ser Ser Arg Asn Glu
140                 145                 150                 155

Cys Asp Arg Phe Pro Asp Ala Leu Lys Pro Gly Cys Tyr Trp Arg Phe
                160                 165                 170

Asp Trp Phe Lys Asn Ala Asp Asn Pro Ser Phe Ser Phe Arg Gln Val
            175                 180                 185

Gln Cys Pro Ala Glu Leu Val Ala Arg Thr Gly Cys Arg Arg Asn Asp
        190                 195                 200

Asp Gly Asn Phe Pro Ala Val Gln Ile Pro Ser Ser Ser Thr Ser Ser
    205                 210                 215

Pro Val Asn Gln Pro Thr Ser Thr Ser Thr Thr Ser Thr Ser Thr Thr
220                 225                 230                 235

Ser Ser Pro Pro Val Gln Pro Thr Thr Pro Ser Gly Cys Thr Ala Glu
                240                 245                 250

Arg Trp Ala Gln Cys Gly Gly Asn Gly Trp Ser Gly Cys Thr Thr Cys
            255                 260                 265

Val Ala Gly Ser Thr Cys Thr Lys Ile Asn Asp Trp Tyr His Gln Cys
        270                 275                 280

Leu
```

(2) INFORMATION FOR SEQ ID NO:3:

(i) SEQUENCE CHARACTERISTICS:
(A) LENGTH: 1473 base pairs
(B) TYPE: nucleic acid
(C) STRANDEDNESS: single
(D) TOPOLOGY: linear (ii) MOLECULE TYPE: cDNA (iii) HYPOTHETICAL: NO (iv) ANTI-SENSE: NO (vi) ORIGINAL SOURCE:
(A) ORGANISM: fusarium oxysporum
(B) STRAIN: DSM 2672

(ix) FEATURE:
(A) NAME/KEY: CDS
(B) LOCATION: 97.1224

(xi) SEQUENCE DESCRIPTION: SEQ ID NO:3:

```
GAATTCGCGG CCGCTCATTC ACTTCATTCA TTCTTTAGAA TTACATACAC TCTCTTTCAA      60

AACAGTCACT CTTTAAACAA AACAACTTTT GCAACA ATG CGA TCT TAC ACT CTT      114
                                        Met Arg Ser Tyr Thr Leu
                                        1               5

CTC GCC CTG GCC GGC CCT CTC GCC GTG AGT GCT GCT TCT GGA AGC GGT      162
Leu Ala Leu Ala Gly Pro Leu Ala Val Ser Ala Ala Ser Gly Ser Gly
            10                  15                  20

CAC TCT ACT CGA TAC TGG GAT TGC TGC AAG CCT TCT TGC TCT TGG AGC      210
His Ser Thr Arg Tyr Trp Asp Cys Cys Lys Pro Ser Cys Ser Trp Ser
        25                  30                  35

GGA AAG GCT GCT GTC AAC GCC CCT GCT TTA ACT TGT GAT AAG AAC GAC      258
Gly Lys Ala Ala Val Asn Ala Pro Ala Leu Thr Cys Asp Lys Asn Asp
    40                  45                  50

AAC CCC ATT TCC AAC ACC AAT GCT GTC AAC GGT TGT GAG GGT GGT GGT      306
Asn Pro Ile Ser Asn Thr Asn Ala Val Asn Gly Cys Glu Gly Gly Gly
55                  60                  65                  70

TCT GCT TAT GCT TGC ACC AAC TAC TCT CCC TGG GCT GTC AAC GAT GAG      354
```

-continued

```
Ser Ala Tyr Ala Cys Thr Asn Tyr Ser Pro Trp Ala Val Asn Asp Glu
                75                  80                  85

CTT GCC TAC GGT TTC GCT GCT ACC AAG ATC TCC GGT GGC TCC GAG GCC      402
Leu Ala Tyr Gly Phe Ala Ala Thr Lys Ile Ser Gly Gly Ser Glu Ala
            90                  95                  100

AGC TGG TGC TGT GCT TGC TAT GCT TTG ACC TTC ACC ACT GGC CCC GTC      450
Ser Trp Cys Cys Ala Cys Tyr Ala Leu Thr Phe Thr Thr Gly Pro Val
        105                 110                 115

AAG GGC AAG AAG ATG ATC GTC CAG TCC ACC AAC ACT GGA GGT GAT CTC      498
Lys Gly Lys Lys Met Ile Val Gln Ser Thr Asn Thr Gly Gly Asp Leu
    120                 125                 130

GGC GAC AAC CAC TTC GAT CTC ATG ATG CCC GGC GGT GGT GTC GGT ATC      546
Gly Asp Asn His Phe Asp Leu Met Met Pro Gly Gly Gly Val Gly Ile
135                 140                 145                 150

TTC GAC GGC TGC ACC TCT GAG TTC GGC AAG GCT CTC GGC GGT GCC CAG      594
Phe Asp Gly Cys Thr Ser Glu Phe Gly Lys Ala Leu Gly Gly Ala Gln
                155                 160                 165

TAC GGC GGT ATC TCC TCC CGA AGC GAA TGT GAT AGC TAC CCC GAG CTT      642
Tyr Gly Gly Ile Ser Ser Arg Ser Glu Cys Asp Ser Tyr Pro Glu Leu
            170                 175                 180

CTC AAG GAC GGT TGC CAC TGG CGA TTC GAC TGG TTC GAG AAC GCC GAC      690
Leu Lys Asp Gly Cys His Trp Arg Phe Asp Trp Phe Glu Asn Ala Asp
        185                 190                 195

AAC CCT GAC TTC ACC TTT GAG CAG GTT CAG TGC CCC AAG GCT CTC CTC      738
Asn Pro Asp Phe Thr Phe Glu Gln Val Gln Cys Pro Lys Ala Leu Leu
    200                 205                 210

GAC ATC AGT GGA TGC AAG CGT GAT GAC GAC TCC AGC TTC CCT GCC TTC      786
Asp Ile Ser Gly Cys Lys Arg Asp Asp Asp Ser Ser Phe Pro Ala Phe
215                 220                 225                 230

AAG GTT GAT ACC TCG GCC AGC AAG CCC CAG CCC TCC AGC TCC GCT AAG      834
Lys Val Asp Thr Ser Ala Ser Lys Pro Gln Pro Ser Ser Ser Ala Lys
                235                 240                 245

AAG ACC ACC TCC GCT GCT GCT GCC GCT CAG CCC CAG AAG ACC AAG GAT      882
Lys Thr Thr Ser Ala Ala Ala Ala Ala Gln Pro Gln Lys Thr Lys Asp
            250                 255                 260

TCC GCT CCT GTT GTC CAG AAG TCC TCC ACC AAG CCT GCC GCT CAG CCC      930
Ser Ala Pro Val Val Gln Lys Ser Ser Thr Lys Pro Ala Ala Gln Pro
        265                 270                 275

GAG CCT ACT AAG CCC GCC GAC AAG CCC CAG ACC GAC AAG CCT GTC GCC      978
Glu Pro Thr Lys Pro Ala Asp Lys Pro Gln Thr Asp Lys Pro Val Ala
    280                 285                 290

ACC AAG CCT GCT GCT ACC AAG CCC GTC CAA CCT GTC AAC AAG CCC AAG     1026
Thr Lys Pro Ala Ala Thr Lys Pro Val Gln Pro Val Asn Lys Pro Lys
295                 300                 305                 310

ACA ACC CAG AAG GTC CGT GGA ACC AAA ACC CGA GGA AGC TGC CCG GCC     1074
Thr Thr Gln Lys Val Arg Gly Thr Lys Thr Arg Gly Ser Cys Pro Ala
                315                 320                 325

AAG ACT GAC GCT ACC GCC AAG GCC TCC GTT GTC CCT GCT TAT TAC CAG     1122
Lys Thr Asp Ala Thr Ala Lys Ala Ser Val Val Pro Ala Tyr Tyr Gln
            330                 335                 340

TGT GGT GGT TCC AAG TCC GCT TAT CCC AAC GGC AAC CTC GCT TGC GCT     1170
Cys Gly Gly Ser Lys Ser Ala Tyr Pro Asn Gly Asn Leu Ala Cys Ala
        345                 350                 355

ACT GGA AGC AAG TGT GTC AAG CAG AAC GAG TAC TAC TCC CAG TGT GTC     1218
Thr Gly Ser Lys Cys Val Lys Gln Asn Glu Tyr Tyr Ser Gln Cys Val
    360                 365                 370

CCC   AAC    TAAATGGTAG ATCCATCGGT TGTGGAAGAG ACTATGCGTC TCAGAAGGGA   1274
Pro   Asn
375

TCCTCTCATG AGCAGGCTTG TCATTGTATA GCATGGCATC CTGGACCAAG TGTTCGACCC   1334
```

TTGTTGTACA TAGTATATCT TCATTGTATA TATTTAGACA CATAGATAGC CTCTTGTCAG 1394

CGACAACTGG CTACAAAAGA CTTGGCAGGC TTGTTCAATA TTGACACAGT TTCCTCCATA 1454

AAAAAAAAAA AAAAAAAAA 1473

( 2 ) INFORMATION FOR SEQ ID NO:4:

( i ) SEQUENCE CHARACTERISTICS:
( A ) LENGTH: 376 amino acids
( B ) TYPE: amino acid
( D ) TOPOLOGY: linear ( i i ) MOLECULE TYPE: protein ( x i ) SEQUENCE DESCRIPTION: SEQ ID NO:4:

Met Arg Ser Tyr Thr Leu Leu Ala Leu Ala Gly Pro Leu Ala Val Ser
1 5 10 15

Ala Ala Ser Gly Ser Gly His Ser Thr Arg Tyr Trp Asp Cys Cys Lys
20 25 30

Pro Ser Cys Ser Trp Ser Gly Lys Ala Ala Val Asn Ala Pro Ala Leu
35 40 45

Thr Cys Asp Lys Asn Asp Asn Pro Ile Ser Asn Thr Asn Ala Val Asn
50 55 60

Gly Cys Glu Gly Gly Gly Ser Ala Tyr Ala Cys Thr Asn Tyr Ser Pro
65 70 75 80

Trp Ala Val Asn Asp Glu Leu Ala Tyr Gly Phe Ala Ala Thr Lys Ile
80 90 95

Ser Gly Gly Ser Glu Ala Ser Trp Cys Cys Ala Cys Tyr Ala Leu Thr
100 105 110

Phe Thr Thr Gly Pro Val Lys Gly Lys Lys Met Ile Val Gln Ser Thr
115 120 125

Asn Thr Gly Gly Asp Leu Gly Asp Asn His Phe Asp Leu Met Met Pro
130 135 140

Gly Gly Gly Val Gly Ile Phe Asp Gly Cys Thr Ser Glu Phe Gly Lys
145 150 155 160

Ala Leu Gly Gly Ala Gln Tyr Gly Gly Ile Ser Ser Arg Ser Glu Cys
165 170 175

Asp Ser Tyr Pro Glu Leu Leu Lys Asp Gly Cys His Trp Arg Phe Asp
180 185 190

Trp Phe Glu Asn Ala Asp Asn Pro Asp Phe Thr Phe Glu Gln Val Gln
195 200 205

Cys Pro Lys Ala Leu Leu Asp Ile Ser Gly Cys Lys Arg Asp Asp Asp
210 215 220

Ser Ser Phe Pro Ala Phe Lys Val Asp Thr Ser Ala Ser Lys Pro Gln
225 230 235 240

Pro Ser Ser Ser Ala Lys Lys Thr Thr Ser Ala Ala Ala Ala Ala Gln
245 250 255

Pro Gln Lys Thr Lys Asp Ser Ala Pro Val Val Gln Lys Ser Ser Thr
260 265 270

Lys Pro Ala Ala Gln Pro Glu Pro Thr Lys Pro Ala Asp Lys Pro Gln
275 280 285

Thr Asp Lys Pro Val Ala Thr Lys Pro Ala Ala Thr Lys Pro Val Gln
290 295 300

Pro Val Asn Lys Pro Lys Thr Thr Gln Lys Val Arg Gly Thr Lys Thr
305 310 315 320

Arg Gly Ser Cys Pro Ala Lys Thr Asp Ala Thr Ala Lys Ala Ser Val

-continued 325 330 335

Val Pro Ala Tyr Tyr Gln Cys Gly Gly Ser Lys Ser Ala Tyr Pro Asn
340 345 350

Gly Asn Leu Ala Cys Ala Thr Gly Ser Lys Cys Val Lys Gln Asn Glu
355 360 365

Tyr Tyr Ser Gln Cys Val Pro Asn
370 375

( 2 ) INFORMATION FOR SEQ ID NO:5:

( i ) SEQUENCE CHARACTERISTICS:
( A ) LENGTH: 415 amino acids
( B ) TYPE: amino acid
( D ) TOPOLOGY: linear ( i i ) MOLECULE TYPE: protein ( x i ) SEQUENCE DESCRIPTION: SEQ ID NO:5:

Gln Lys Pro Gly Glu Thr Lys Glu Val His Pro Gln Leu
5 10

Thr Thr Phe Arg Cys Thr Lys Arg Gly Gly Cys Lys Pro
15 20 25

Ala Thr Asn Phe Ile Val Leu Asp Ser Leu Ser His Pro
30 35

Ile His Arg Ala Glu Gly Leu Gly Pro Gly Gly Cys Gly
40 45 50

Asp His Gly Asn Pro Pro Pro Lys Asp Val Cys Pro Asp
55 60 65

Val Glu Ser Cys Ala Lys Asn Cys Ile Met Glu Gly Ile
70 75

Pro Asp Tyr Ser Gln Tyr Gly Val Thr Thr Asn Gly Thr
80 85 90

Ser Leu Arg Leu Gln His Ile Leu Pro Asp Gly Arg Val
95 100

Pro Ser Pro Arg Val Tyr Leu Leu Asp Lys Thr Lys Arg
105 110 115

Arg Tyr Glu Met Leu His Leu Thr Gly Phe Glu Phe Thr
120 125 130

Phe Asp Val Asp Ala Thr Lys Leu Pro Cys Gly Met Asn
135 140

Ser Ala Leu Tyr Leu Phe Glu Asn His Pro Thr Gly Ala
145 150 155

Lys Ser Lys Tyr Asn Ser Gly Gly Ala Tyr Tyr Gly Thr
160 165

Gly Tyr Cys Asp Ala Gln Cys Phe Val Thr Pro Phe Ile
170 175 180

Asn Gly Leu Gly Asn Ile Glu Gly Lys Gly Ser Cys Cys
185 190 195

Asn Glu Met Asp Ile Trp Glu Val Asn Ser Arg Ala Ser
200 205

His Val Val Pro His Thr Cys Asn Lys Lys Gly Leu Tyr
210 215 220

Leu Cys Glu Gly Glu Glu Cys Ala Phe Glu Gly Val Cys
225 230

Asp Lys Asn Gly Cys Gly Tyr Asn Asn Tyr Arg Val Asn
235 240 245

-continued

| | | | | | | | | | | | | |
|---|---|---|---|---|---|---|---|---|---|---|---|---|
| Val | Thr | Asp | Tyr | Tyr | Gly | Arg | Gly | Glu | Glu | Phe | Lys | Val |
| | | 250 | | | | | 255 | | | | | 260 |
| Asn | Thr | Leu | Lys | Pro | Phe | Thr | Val | Val | Thr | Gln | Phe | Leu |
| | | | | 265 | | | | | 270 | | | |
| Ala | Asn | Arg | Arg | Gly | Arg | Leu | Glu | Lys | Ile | His | Arg | Phe |
| | 275 | | | | | 280 | | | | | 285 | |
| Tyr | Val | Gln | Asp | Gly | Lys | Val | Ile | Glu | Ser | Phe | Tyr | Thr |
| | | | 290 | | | | | 295 | | | | |
| Asn | Lys | Glu | Gly | Val | Pro | Tyr | Thr | Asn | Met | Ile | Asp | Asp |
| 300 | | | | | 305 | | | | | 310 | | |
| Glu | Phe | Cys | Glu | Ala | Thr | Gly | Ser | Arg | Lys | Tyr | Met | Glu |
| | | 315 | | | | | 320 | | | | | 325 |
| Leu | Gly | Ala | Thr | Gln | Gly | Met | Gly | Glu | Ala | Leu | Thr | Arg |
| | | | | 330 | | | | | 335 | | | |
| Gly | Met | Val | Leu | Ala | Met | Ser | Ile | Trp | Trp | Asp | Gln | Gly |
| | 340 | | | | | 345 | | | | | 350 | |
| Gly | Asn | Met | Glu | Asn | Leu | Asp | His | Gly | Glu | Ala | Gly | Pro |
| | | | 355 | | | | | 360 | | | | |
| Cys | Ala | Lys | Gly | Glu | Gly | Ala | Pro | Ser | Asn | Ile | Val | Gln |
| 365 | | | | | 370 | | | | | 375 | | |
| Val | Glu | Pro | Phe | Pro | Glu | Val | Thr | Tyr | Thr | Asn | Leu | Arg |
| | | 380 | | | | | 385 | | | | | 390 |
| Trp | Gly | Glu | Ile | Gly | Ser | Thr | Tyr | Gln | Glu | Val | Gln | Lys |
| | | | | 395 | | | | | 400 | | | |
| Pro | Lys | Pro | Lys | Pro | Gly | Met | Gly | Pro | Arg | Ser | Asp | |
| | 405 | | | | | 410 | | | | | 415 | |

What is claimed is:

1. A liquid detergent composition comprising the following:

a) 1% to 50% by weight of an anionic surfactant;

b) about 0.01% to 10% of a cellulase enzyme which is an endoglucanase enzyme having an amino acid sequence shown in the appended sequence listing ID#5, or is a homologue thereof exhibiting endoglucanase activity;

c) about 0.5% to 10% of a nitrogen-containing compound selected from the group consisting of amines having the formula $R_1R_2R_3N$ wherein $R_1$ or $R_2$ are independently H or a $C_2$–$C_9$ alkyl chain, cyclohexyl, cyclopentyl or cycloheptyl, quaternary ammonium compounds having the formula $R_4R_5R_6R_7{}^+X^-$ where X is a halogen, $R_4$ is a $C_6$–$C_{22}$ alkyl chain and $R_5R_6R_7$ are independently a $C_1$–$C_9$ alkyl chain, hydroxy ethyl or hydroxypropyl or mixtures thereof.

2. A liquid detergent composition according to claim 1 wherein said anionic surfactant is alkyl alkoxylated sulphate.

* * * * *